United States Patent [19]

Davies

[11] 4,051,282

[45] Sept. 27, 1977

[54] PRODUCTION OF TREATED WOOD HAVING EASY PENETRABILITY

[75] Inventor: Dan L. Davies, Gibsonia, Pa.

[73] Assignee: Koppers Company, Inc., Pittsburgh, Pa.

[21] Appl. No.: 695,577

[22] Filed: June 14, 1976

[51] Int. Cl.[2] ..... B05D 1/18; B05D 3/02

[52] U.S. Cl. ..... 427/393; 21/7; 427/441; 427/442; 427/443

[58] Field of Search ..... 21/7; 427/393, 441, 427/442, 443

[56] References Cited

U.S. PATENT DOCUMENTS

| | | | |
|---|---|---|---|
| 2,799,597 | 7/1957 | Walker et al. | 427/441 X |
| 3,200,003 | 8/1965 | Bescher | 427/325 X |

FOREIGN PATENT DOCUMENTS

| | | | |
|---|---|---|---|
| 228,119 | 2/1925 | United Kingdom | 427/441 |

*Primary Examiner*—Michael R. Lusignan

*Attorney, Agent, or Firm*—Kenneth J. Stachel; Herbert J. Zeh, Jr.; Oscar B. Brumback

[57] ABSTRACT

Production of treated wood with improved penetrability by projectiles is accomplished in an improved pressure treatment with an improved treating solution. The wood is impregnated in a pressure treatment process with a treating solution containing an impregnant, an aliphatic hydrocarbon or halogenated hydrocarbon liquid carrier, a cosolvent if the solubility of the impregnant in the liquid carrier is inadequate, and an effective amount of lubricating oil. After the treating solution has impregnated the wood, the liquid carrier is evaporated leaving treated wood containing an impregnant with internal lubrication due to the oil and possibly some cosolvent.

10 Claims, No Drawings

PRODUCTION OF TREATED WOOD HAVING EASY PENETRABILITY

BACKGROUND OF THE INVENTION

This invention relates to processes and treating solutions for impregnating wood at elevated pressures with impregnants such as preservatives and fire retardants in a liquid carrier which is subsequently evaporated from the wood. In particular, the invention relates to processes and treating solutions for impregnating wood with pentachlorophenol contained in an aliphatic hydrocarbon or halogenated aliphatic hydrocarbon liquid carrier which boils below 130° C. at ambient atmospheric pressure and readily liquefies at ambient atmospheric temperatures when placed under elevated pressure.

Traditionally, wood has been impregnated with creosote and more recently with a solution of pentachlorophenol and oil to preserve the wood against fungus, insects, and the like. Additionally, such solutions when impregnated into wood, especially utility poles, serve as a lubricant so that projectiles such as, for example, nails, climbing irons and the like easily penetrate the wood when pressure is applied against the projectiles.

Within the last 15 years pressure treatment processes for wood have emerged wherein the liquid carrier for the impregnant is evaporated from the treated wood. These processes involve impregnating wood at an elevated pressure with a treating solution containing an impregnant such as a preservative or fire retardant in a liquid carrier such as an aliphatic hydrocarbon. These liquid carriers are liquid at wood impregnating conditions of elevated pressure but boil at a temperature below 130° C. at ambient pressure and, therefore, may be removed from the treated wood by evaporation.

In addition, the treating solution may contain a cosolvent for the impregnant which also is soluble in the liquid carrier. Examples of these types of processes are described in U.S. Pat. Nos. 3,199,211 and 3,200,003 and Canadian Pat. No. 863,885.

The elevated pressure wood treating processes wherein the liquid carrier is evaporated from the treated wood produces a treated wood that does not possess internal lubrication like that present in creosote treated wood. Consequently, the treated wood from such elevated pressure wood treating processes is more resistant to penetration with projectiles. When the treated wood is a utility pole, a considerable effort is required by linemen to insert the spur of their climbing iron into the pole. If the spur does not penetrate the pole to a safe depth the lineman would not have ample support, thereby increasing the hazards of pole climbing.

It is an object of this invention to provide a process and treating solution to produce wood from a pressure impregnation treatment that allows for improved penetration of projectiles without deleteriously affecting the efficacy of the impregnant in the wood or the benefits of the pressure treatment.

SUMMARY OF THE INVENTION

The present invention is an improvement in the process and treating solution used for impregnating wood in a pressure treatment with a treating solution containing an impregnant such as a preservative or fire retardant and a liquid carrier such as an aliphatic hydrocarbon or a halogenated aliphatic hydrocarbon that readily liquefies at ambient atmospheric temperatures when placed under elevated pressure. The treating solution also may contain a cosolvent for the impregnant that is soluble in the liquid carrier. After impregnation is accomplished at elevated pressures, the liquid carrier is removed from the treated wood by evaporation.

The improvement embodying the present invention is the use of an oil in the treating solution containing the impregnant, liquid carrier and possibly a cosolvent.

The improvement in such a wood treating process comprises:

adding to the treating solution an effective lubricating amount of an oil having a kinematic viscosity of not less than 2.5 centistokes (cSt) at 100° F. (37.78° C.) and not more than 5.8 centistokes (cSt) at 100° F. (37.78° C.) and having a distillation range such that not more than about 50 percent of the volume distills below or about 450° F. (232.22° C.) and not more than about 90 percent of the volume distills below or about 550° F. (287.78° C.).

By virtue of the foregoing improvement the wood impregnated with the oil-containing treating solution and treated to evaporate the aliphatic hydrocarbon or halogenated hydrocarbon solvent is easier to penetrate with projectiles than is wood treated with a treating solution not containing oil.

The effective lubricating amount of the lubricating oil is any concentration of oil in the treating solution from less than one percent to a percentage less than the percentage that would be detrimental to the clean appearance of the treated wood. This effective lubricating amount will differ for different species of wood and for the different sizes of wood treated.

DESCRIPTION OF THE INVENTION

The treating solution containing the oil additive is prepared by adding the oil to the other components of the treating solution. The addition must allow the impregnant to be soluble in the final treating solution. Besides this consideration there is no special order of addition. Usually, the impregnant is dissolved in the liquid carrrier or a cosolvent if the liquid carrier has a low solubility for the impregnant. If this is the case, the liquid carrier and impregnant cosolvent solution are combined. After having the impregnant in solution in effective amounts, as known by those skilled in the art, the effective lubricating amount of oil is added. This solution containing oil is used to impregnate the wood.

Generally, the impregnation of the wood with the oil-containing treating solution is accomplished in a confined zone from ambient temperature to a temperatyre around 120° C. and under at least sufficient pressure to maintain the liquid carrier in the liquid state at the operating temperature and allow impregnation of the wood by the oil-containing treating solution. The wood is held at these operating conditions for a sufficient period of time to allow sufficient impregnation of the wood by the treating solution. This time, as well as the other operating conditions, are well known in the art, since the treatment with oil-containing treating solution is performed in the same manner as treatment with the treating solutions known in the art. After the impregnation is completed, the excess liquid carrier is removed from the zone. Then the impregnated wood can be treated by heat with a heat transfer medium or by residual heat from impregnation with or without a vacuum to remove the liquid carrier from the impregnated wood by evaporation. The zone is then opened and the wood removed. Either the well-known full cell or empty cell process may be used for impregnating the wood, but often times it is desirable to use an empty cell process as some of the liquid carrier is removed from the wood by the expansion of the non-condensable gases, thus less heat is required to carry out the volatilization of the remaining solvent.

Impregnants used in wood pressure treatments and useful in this invention include those agents which protect wood against deterioration due to fungus, insects, fire and the like. Examples of these agents include polychlorinated phenols like pentachlorophenol, 2,3,4,6-tetrachlorophenol, 2,4,5-trichlorophenol, 2,4,6-trichlorophenol, 4-chloro-2-chloropentylphenol; and others like betanaphthol, copper naphthenate, tributyltin oxide and phenyl mercury oleate. Other known wood-preservative compounds which are soluble or can be dispersed in the aliphatic hydrocarbon or halogenated hydrocarbon solvents useful in this invention may be used. Examples of fire retardant chemicals include tris (haloalkyl) phosphonates, bis (2-chloroethyl) chloroethanephosphonate, tris (2-chloroethyl) phosphonate, tri (2,3-dibromopropyl) phosphate, the aziridinylphosphine oxides, trisaziridinylphosphine oxide, and the like.

Aliphatic hydrocarbon or halogenated hydrocarbon solvents used in wood pressure treatments and useful in this invention include propane, n-butane, isobutane, n-pentane, isopentane and mixtures thereof all in the liquid phase; and polyhalomethanes, polyhaloethanes, and polyhaloethylenes having boiling points above about 35° C. and below about 130° C. like methylene chloride, chloroform, carbon tetrachloride, methylene chlorobromide, 1,1,1-trichloroethane, dibromodifluoroethane, dichlorotetrafluoroethane, trichlorotrifluoroethane, tetrafluorodibromoethane, tetrachlorodifluoroethane, cis-or trans dichloroethylene, trichloroethylene, perchloroethylene, 1,1-dichloroethane, and ethylene chloride.

If the aliphatic hydrocarbon solvent has only a moderate or slight solubility for the preservative in a wood pressure preservative treatment, a cosolvent may be used. Examples of these cosolvents include benzene, nitrobenzene, di- and tri-chlorobenzene, alkyl benzene, hydroxy benzene, ethyl ether, isopropyl ether, vinyl ethyl ether, dibutyl ether, dibutyl ketone, diidobutyl ketone, methyl isobutyl ketone, benzonitrile, decalin, tetralin, butyraldehyde, and isobutyraldehyde.

The oils useful in the process of this invention are any oils circumscribed by the following limitations: having a kinematic viscosity of not less than 2.5 centistokes (cSt) at 100° F. (37.78° C.) and not more than 5.8 centistokes (cSt) at 100° F. (37.78° C.) and having a distillation range such that not more than about 50 percent of the volume distills below or about 450° F. (232.22° C.) and not more than about 90 percent of the volume distills below or about 550° F. (287.78° C.). An example of an oil within this definition is No. 2 fuel oil. This No. 2 fuel oil may be obtained from many of the petroleum refining companies. The No. 2 fuel oil is an American Society for Testing Materials (ASTM) specification for fuel oils. This grade number 2 fuel oil is a heavier distillate than grade No. 1. It is intended for use in atomizing type burners which spray the oil into a combustion chamber where the tiny droplets burn while in suspension. Another example of an oil within the above definition is Type A hydrocarbon solvent described in American Wood-Preservers' Association Standard P9-75 Standard for Solvents for Oil Preservative Systems.

The amount of oil used in the process of this invention is an effective lubricating amount. Broadly, this amount of oil added to a treating solution is an amount less than one percent of the treating solution to a percentage less than the percentage that would be detrimental to the clean appearance of the treated product. At higher concentrations there is a dissatisfactory tendency for development of an oily surface on the pole or other wood product. Also, higher concentrations of lubricating oil in the treating solution is uneconomic since excellent results are obtained with lower concentrations. The particular effective amount of oil will vary for different species of wood. For Douglas fir wood and Southern Yellow Pine wood the practical effective amount of oil added to the treating solution is in the range of around 1.5 percent to around 15 percent of the total treating solution.

In the preferred embodiment of this invention the impregnant used is pentachlorophenol. The preferred liquid carrier is liquefied petroleum gas, in which case, the preferred cosolvent is isopropyl ether. Also, the wood treated is preferably one of the softwood species commonly used for utility poles.

The preferred method of initially making the oil-containing treating solution is to take an inventory of a treating solution, such as pentachlorophenol carried in a liquid carrier, liquefiled butane, along with the cosolvent isopropylether, contained in a storage tank and calculate the results in terms of pounds. An amount of lubricating oil, preferably No. 2 fuel oil, equivalent to about 1.5% to about 15% and most preferably about 3% to about 10% by weight of the treating solution in the inventory is then added to a closed pressure treating cylinder known to those skilled in the art of wood pressure treatment. The cylinder is then filled with treating solution from the storage tank and this is flushed back and forth between the two tanks to completely intermix the No. 2 fuel oil with the treating solution. The oil-containing treating solution is then ready to treat wood including a charge of wood poles or other wood product.

Once the initial oil-containing treating solution has been made, it is more convenient to add the No. 2 fuel oil using standard mixing facilities available at the existing wood-treating plants. An amount of pentachlorophenol (penta) from a bulk storage bin or from bags is added to a penta mix pot. The amount added is sufficient in pounds to treat a charge of wood in such a manner as to leave the desired retention of penta in the wood. An amount of No. 2 fuel oil required to maintain the preferred concentration, of about 3% to about 10%, in the treating solution is then added to the mix pot. Similarly, an amount of cosolvent, such as isopropylether, is added to the mix pot. The amount of No. 2 fuel oil added to the mix pot should be in the same ratio to the penta added as the percent No. 2 fuel oil in the treating solution is to the percent penta in the treating solution. For example, if the treating solution contains 3% No. 2 fuel oil and 5% penta, then 3 lbs. of No. 2 fuel oil should be added to the mix pot for every 5 lbs. of penta added to the mix pot. After the penta, No. 2 fuel oil and cosolvent are added to the mix pot, the pot is closed and hot oil-containing treating solution is circulated either from the cylinder or from a oil-containing treating solution hold tank through the mix pot and back to the oil-containing treating solution hold tank until the ingredients are in solution and thorougly mixed into the oil-containing treating solution. The oil-containing treating solution is then ready to treat another charge of wood poles or other wood product.

For full cell operation, the wood to be treated and impregnated is enclosed in a hermetically sealed cylinder. The air in the cylinder and consequently any air in the wood is evacuated, that is, there is a purge to remove the oxygen to below 3 percent so as to avoid reaching the explosive range. This usually requires about 15 minutes. A treating solution containing the liquefied petroleum gas plus isopropyl ether, plus pentachlorophenol plus No. 2 fuel oil, is introduced into the cylinder by first equalizing the pressure of the oil-containing treating solution in a pressure storage tank with the vacuum in the treating cylinder. The cylinder is filled by gravity feed or pumping in additional treating solution. The pressure is then raised either by means of heat applied to the solution or by pumping additional solution into the cylinder and this elevated pressure is maintained until the wood is impregnated with the oil-containing treating solution.

When sufficient pentachlorophenol has been put into the wood, the liquid is returned from the cylinder to the pressure storage tank, utilizing either the vapor pressure developed in the cylinder or pumps to effect the transfer. A vapor pump is used to remove the vapors in the cylinder. As the vapor pressure in the cylinder is reduced, liquefied petroleum gas contained in the wood evaporates and these vapors are returned similarly to the storage tank. After the gases contained in the treated wood have been evaporated, condensed, and placed in a pressure storage tank, the treating cylinder is subjected to a final vacuum to remove last traces of hydrocarbons, then the cylinder is purged with inert gas to reduce hydrocarbon vapor to less than 4 percent. The cylinder is then opened and the wood removed.

For empty cell operation, using a non-combustible gas, the wood is enclosed in a hermetically sealed cylinder, the air evacuated, and an inert gas, such as nitrogen, is introduced at a relatively low pressure, such as 15 pounds per square inch, and forced into the wood. On top of this gas, treating solution containing liquefied petroleum gas, isopropyl ether, pentachlorophenol, and No. 2 fuel oil is impregnated into the wood, resulting in a cushion of inert gas under pressure within the wood and under the treating solution. When the impregnating cycle is ended, the liquid carrier is returned into the pressure storage tank. The quantity of liquid carrier retained in the wood during treatment is lessened, thus recovery is enacted more quickly, and the cylinder can be opened earlier. Further details on the full cell and empty cell operations are contained in U.S. Pat. No. 3,200,003 which is hereby incorporated by reference into this disclosure since the operation is similarly performed.

The used treating solution from empty or full cell operation is returned to a oil-containing treating solution hold tank, a portion generally being transferred first to the penta mix pot and then to the oil-containing treating solution hold tank as previously described. Any water picked up in the treating cylinder or from the wood is decanted from the treating solution. The pentachlorophenol content is then adjusted to approximately 5 percent by the addition of isopropyl ether-oil-pentachlorophenol treating solution from the cosolvent oil pentachlorophenol mix tank. This adjusted treating solution is transferred to the solvent penta storage tank and is ready to treat the next charge of wood.

In an alternative embodiment of this invention wood in the physical form of posts, poles and the like are treated with an oil-containing treating solution which contains pentachlorophenol as the impregnant, a halogenated hydrocarbon, for example methylene chloride, as the liquid carrier and No. 2 fuel oil or Type A P9-75 oil as the lubricating oil. This oil-containing treating solution is made by adding preferably No. 2 fuel oil to the liquid halogenated hydrocarbon solvent which contains from about 2.0 to about 5.5 weight percent of pentachlorophenol. The oil-containing treating solution should contain preferably from about 4.5 to about 5.5 weight percent of pentachlorophenol and about 1.5 to about 15 weight percent of No. 2 fuel oil, preferably about 3 to about 10 weight percent, with the remainder of the oil-containing treating solution consisting of the halogenated hydrocarbon solvent plus any additional additives like anti-blooming agents.

This oil-containing treating solution is added to a treating cylinder or other treating chamber wherein the wood poles or the like are present. This oil-containing treating solution is impregnated into the wood poles by soaking or by means of pressure up to about 150 psig (11.2 atmospheres). The amount of time needed for impregnation depends upon the porosity and moisture content of the wood being treated. Generally in the pressure impregnation the time required is 30 minutes to several hours. The temperature during impregnation of the wood with the oil-containing treating solution is at or near ambient temperatures from about 0° to about 35° C.

When the impregnation step is completed, excess preservative solution is drained from the treating cylinder and the treated wood is contacted with a fluid heating medium such as steam or vapors of a halogenated solvent. The contacting is conducted at atmospheric pressure with 100° steam, although higher pressures and temperatures may be used. The vapors from the steaming step may be condensed and the halogenated hydrocarbon solvent phase separated from the aqueous phase and both reused in the process.

As with the preferred embodiment of this invention, the alternative embodiment may be conducted in a full or empty cell operation.

Standard "hardness" tests which involve scratching a surface, crushing or driving some object into a material with a constant force or the like are less than adequate as a standard test to determine the ease of penetration of wood with a projectile. Consequently, a test was developed which drives a nail into a piece of wood, especially a pole, with an impact load provided by dropping a weight from a constant height. Pieces of wood are tested before and after treatment by the process and treating solution of this invention. The length of the nail left protruding above the surface was then determined. The difference between these values is recorded as the penetration depth.

The following are examples of some of the actual tests made in accordance with the foregoing described process and treating solution.

EXAMPLE I

Five Southern Yellow Pine (SYP) poles were treated with treating solutions containing approximately 5 weight percent pentachlorophenol (PCP), 7.5 weight percent isopropyl ether (IPE) with 1.8 or 4.2 weight percent of No. 2 fuel oil and the remainder of the solution composed of liquefied petroleum gas (LPG).

The poles were placed in a commercial size cylinder and the cylinder door closed and sealed. The oil-containing treating solution was added to the cylinder until the wood charge was covered with treating solution. The pressure in the cylinder was increased to about 125 psig and the temperature of the treating solution was increased to 160° F. at which temperature the solution has a vapor pressure of about 125 psig. This pressure was maintained for sufficient time, such as two to three hours, to effect the impregnation of the wood with the treating solution. The treating solution was removed from the cylinder and the liquefied petroleum gas was evaporated. Then the cylinder door was opened and the wood removed.

Hardness tests by a 16*d* nail test were performed on the SYP poles before and after treatment. The average percent improvement of observed values from the 16*d* nail tests for the three treatments over untreated samples are presented in Table I.

Table I

Penetration of 16d Nails in Southern Yellow Pine Poles Impregnated in a Pressure Treatment

| Pole Sample | Treating Solution | Average Nail Penetration Before Treatment | Average Nail Penetration After Treatment | Percent Improvement |
|---|---|---|---|---|
| | PCP/IPE/LPG | | | |
| 1 | + 0% No.2 fuel oil | .580 | .620 | 6.9 |
| 2 | | .587 | .551 | −6.1 |
| 3 | | .598 | .567 | −5.2 |
| 4 | | .595 | .598 | 0.1 |
| 5 | | .631 | .653 | 3.5 |
| | | | | Average −0.2% |
| 6 | + 1.8% No.2 fuel oil | .577 | .632 | 9.5 |
| 7 | | .647 | .667 | 3.1 |
| 8 | | .522 | .565 | 8.2 |
| 9 | | .791 | .769 | −2.8 |
| 10 | | .681 | .684 | 0.0 |
| | | | | Average 3.6% |
| 11 | + 4.2% No.2 fuel oil | .739 | .771 | 4.3 |
| 12 | | .677 | .788 | 16.3 |
| 13 | | .860 | .898 | 4.4 |
| 14 | | .766 | .867 | 13.1 |
| 15 | | .799 | .848 | 6.1 |
| | | | | Average 8.8% |

EXAMPLE II

Full size Douglas fir poles were treated with a treating solution containing approximately 5 percent pentachlorophenol (PCP), 7.5 percent isopropyl ether (IPE) with varying amounts of a light No. 2 diesel fuel oil, and the remainder of the solution composed of liquefied petroleum gas (LPG). The concentrations of the oil in the different treating solutions were 3, 4, 6, 7, 8, 9, and 10 percent oil. Also, a treating solution with no oil was tested as well as a treating solution of creosote.

The poles were placed in a commercial sized cylinder and the cylinder door closed and sealed. The oil-containing treating solution was added to the cylinder until the wood charge was covered with treating solution. The pressure in the cylinder was increased to about 125 psig. The temperature of the treating solution was increased to 160° F. at which temperature the solution has a vapor pressure of about 125 psig. This pressure was maintained for sufficient time, such as two to three hours to effect the impregnation of the wood with the treating solution. The treating solution was removed from the cylinder and the liquefied petroleum gas was evaporated. Then the cylinder door was opened and the wood removed.

Both before and after treatment the Douglas fir poles were subjected to the 16d nail penetration test. The average percent improvement and range of observed values from the 16*d* nail tests for the various treatments over untreated samples are presented in Table II.

Table II

Penetration of 16d Nails in Full Sized Douglas Fir Poles Impregnated in a Pressure Treatment

| Treating Solution | Percent Improvement in Penetration | Range of Percent Improvement in Penetration |
|---|---|---|
| PCP/IPE/LPG | −2.5 | −7.0 - 0.5 |
| + 3% No. 2 Fuel Oil | 13.5 | 3.0 - 22.0 |
| + 4% No. 2 Fuel Oil | 12.0 | 10.0 - 15.0 |
| + 6% No. 2 Fuel Oil | 5.0 | −4.0 - 10.5 |
| + 7% No. 2 Fuel Oil | 6.5 | 0.0 - 7.0 |
| + 8% No. 2 Fuel Oil | 7.0 | 3.0 - 11.0 |
| + 9% No. 2 Fuel Oil | 9.0 | 2.5 - 14.0 |
| + 10% No. 2 Fuel Oil | 7.0 | 2.5 - 11.5 |
| Creosote | 24.0 | 20.0 - 27.5 |

The values given in Table II are the average values and the ranges of values of ten (10) runs. The group of poles treated with a treating solution without oil were harder to penetrate after treatment than before treatment. The treatment with a treating solution containing the oil differed significantly from those treated with the treating solution without oil.

Table III presents data from the average values of several runs showing the effectiveness of treating wood with a treating solution containing pentachlorophenol, isopropyl ether, liquefied petroleum gas, and oil. The data in Table III also show that the effectiveness, judged by pentachlorophenol retentions, of the treating process is not reduced by the presence of the oil in the treating solution.

Table III

Comparison of Several Treating Solutions

| Treating Solution | Creosote | PCP-IPE LPG | +3% Oil | +4% Oil | +6% Oil | +7% Oil | +8% Oil | +9% Oil | +10% Oil |
|---|---|---|---|---|---|---|---|---|---|
| % Improvement Over Untreated 16d Nail Penetration Test | 23.9 | −3.4 | 15.7 | 12.8 | 4.7 | 3.8 | 6.3 | 5.5 | 7.0 |
| Pole Class - Size | 4/40 | 5/45 | 5/35 | 5/35 | 5/45 | 2/60 | 4/40 | 4/40 | 2/60 |
| Penta Ret. (pcf) | | | | | | | | | |

Table III-continued

| Treating Solution | Creosote | PCP-IPE LPG | +3% Oil | +4% Oil | +6% Oil | +7% Oil | +8% Oil | +9% Oil | +10% Oil |
|---|---|---|---|---|---|---|---|---|---|
| | Comparison of Several Treating Solutions | | | | | | | | |
| 0–0.5 inch Density[2] (pcf) | 12.2[1] | 0.21 | 0.94 | 0.55 | 0.75 | 0.84 | 0.46 | 0.61 | 0.70 |
| 0–0.5 inch Density[3] (pcf) | | 36.7 | 37.4 | 41.0 | 33.6 | 34.8 | — | 37.6 | 40.0 |
| 0–0.5 inch | | 26.3 | 26.8 | 25.0 | 23.9 | 27.8 | 20.7 | 25.9 | 26.2 |

[1]Creosote retention.
[2]By Hg immersion of plugs.
[3]By visual observation of rings, fraction summerwood, etc.
PCP = pentachlorophenol;
IPE = isopropyl ether;
LPG = liqued petroleum gas.
Oil = No. 2 fuel oil.

According to the provisions of the patent statutes, the principle, preferred construction and mode of operation of the invention have been explained and what is considered to represent its best embodiment has been illustrated and described. However, it should be understood that within the scope of the appended claims the invention may be practiced otherwise than specifically illustrated and described.

I claim:

1. In a pressure treating process for wood wherein wood is impregnated with a treating solution containing one or more impregnants selected from the group of preservatives and fire retardants and a liquid carrier selected from the group consisting of aliphatic hydrocarbons and halogenated aliphatic hydrocarbons that are liquids at elevated pressures and that have boiling points below 130° C. at atmospheric pressure and wherein the impregnated wood is treated to evaporate the liquid carrier, the improvement which comprises:

adding to the treating solution an effective lubricating amount of an oil having a kinematic viscosity of not less than 2.5 centistokes at 100° F. and not more than 5.8 centistokes at 100° F. and having a distillation range such that not more than about 50 percent of the volume distills below or about 450° F. and not more than about 90 percent of the volume distills below or about 550° F.

2. Process according to claim 1 wherein an amount of oil in the range of around 1.5 percent to around 15 percent of the total treating solution is added to the treating solution.

3. Process according to claim 1 wherein the aliphatic hydrocarbon is selected from the group consisting of propane, n-butane, isobutane, and mixtures thereof and the impregnant is one or more preservatives selected from the group consisting of polychlorinated phenols, copper quinolinolate, tributyl tin oxide and copper naphthenate.

4. Process according to claim 1 wherein a cosolvent in which the impregnant is substantially soluble and which is substantially soluble in the liquid carrier is used to aid in solubilizing the impregnant in the liquid carrier.

5. Process according to claim 1 wherein the halogenated aliphatic hydrocarbon is methylene chloride.

6. Process according to claim 1 wherein the oil is a No. 2 fuel oil.

7. In a process for the impregnation of wood with a liquid preservative comprising:

A. immersing the wood in a treating solution at pressures above ambient pressure, 1. said treating solution comprising:

a. an aliphatic hydrocarbon which is selected from the group consisting of propane, n-butane, isobutane, n-pentane, isopentane, and mixtures thereof and which is in the liquid state;

b. a preservative selected from the group consisting of copper quinolinolate and pentachlorophenol; and c. a cosolvent, differing in its molecular structure from said aliphatic hydrocarbon, that has less than 10% water solubility, that has at least 25% solubility for the preservative, and that is soluble in the hydrocarbon to form a treating solution containing at least 2% by weight preservative, said treating solution containing at least 2% by weight of said cosolvent.

B. separating said treating solution from the wood, and

C. evaporating the aliphatic hydrocarbon from the impregnated wood autogenously whereby the preservative remains in the wood, the improvement comprising:

adding to said treating solution an effective lubricating amount of an oil having a kinematic viscosity of not less than 2.5 centistokes at 100° F. and not more than 5.8 centistokes at 100° F. and having a distillation range such that not more than about 50 percent of the volume distills below or about 450° F. and not more than about 90 percent of the volume distills below or about 550° F.

8. Process according to claim 5 wherein the effective lubricating amount of oil is in the range of around 1.5 percent to around 15 percent of the total treating solution.

9. An improved wood treating solution useful in pressurized wood treating processes wherein the treating solution containing pentachlorophenol, isopropyl ether, and liquefied petroleum gas impregnates the wood, and the liquefied petroleum gas is evaporated from the treated wood, the improvement comprising:

having a treating solution containing:

2 to 7.5 percent pentachlorophenol, 3 to 12 percent isopropyl ether, 65 to 93 percent liquefied petroleum gas, and 1.5 to 15 percent of an oil having a kinematic viscosity of not less than 2.5 centistokes at 100° F. and not more than 5.8 centistokes at 100° F. and having a distillation range such that about 50 percent of the volume distills below or about 450° F. and not more than about 90 percent of the volume distills below or about 550° F.

10. An improved treating solution of claim 9 wherein the oil is No. 2 fuel oil.

* * * * *